United States Patent [19]

Nakase

[11] Patent Number: 4,702,714

[45] Date of Patent: Oct. 27, 1987

[54] TILT MECHANISM FOR MARINE PROPULSION DEVICE

[75] Inventor: Ryoichi Nakase, Hamamatsu, Japan

[73] Assignee: Sanshin Kogyo Kabushiki Kaisha, Japan

[21] Appl. No.: 811,314

[22] Filed: Dec. 18, 1985

[30] Foreign Application Priority Data

Mar. 19, 1983 [JP] Japan ..... 58-45321

[51] Int. Cl.[4] ..... B63H 5/12

[52] U.S. Cl. ..... 440/61; 440/53

[58] Field of Search ..... 440/53, 55, 56, 61, 440/65

[56] References Cited

U.S. PATENT DOCUMENTS

| | | | |
|---|---|---|---|
| 3,722,455 | 3/1973 | Carpenter | 440/61 |
| 3,839,986 | 10/1974 | Meyer | 440/61 |
| 3,842,789 | 10/1974 | Bergstedt | 440/61 |
| 3,885,517 | 5/1975 | Borst | 440/61 |
| 4,096,820 | 6/1978 | Hall | 440/61 |
| 4,391,592 | 7/1983 | Hundertmark | 440/61 |
| 4,395,239 | 7/1983 | Hall | 440/61 |

*Primary Examiner*—Joseph F. Peters, Jr.
*Assistant Examiner*—Clifford T. Bartz
*Attorney, Agent, or Firm*—Ernest A. Beutler

[57] ABSTRACT

A tilt and trim arrangement for an outboard drive wherein the hydraulic control system is effective to cause tilting up of the outboard drive without necessitating movement of the trim cylinder assembly.

9 Claims, 8 Drawing Figures

Fig-1
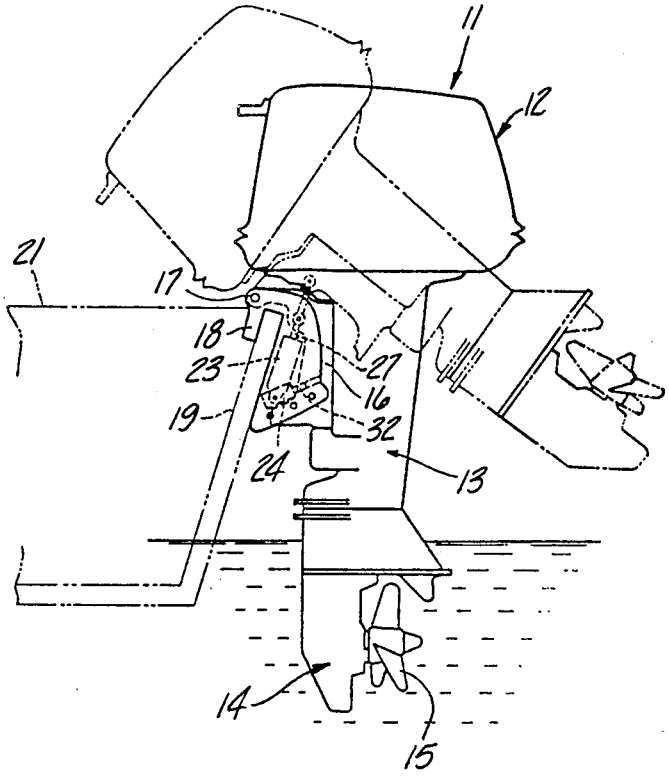
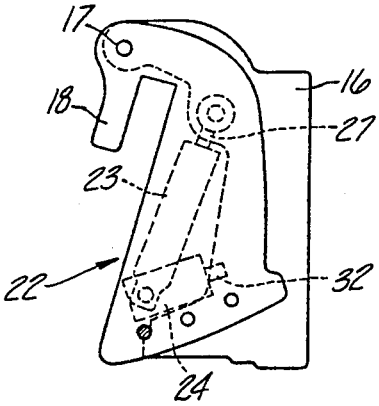
Fig-2

TILT MECHANISM FOR MARINE PROPULSION DEVICE

This application is a continuation of application Ser. No. 590,286, filed Mar. 16, 1984, and now abandoned.

BACKGROUND OF THE INVENTION

This invention relates to a tilt mechanism for marine propulsion devices and more particularly to an improved tilt and trim unit for an outboard drive.

Many types of outboard drives, particularly the ones associated with higher horsepower units, employ hydraulic tilt and trim arrangements for tilting the outboard drive up out of the water when not in use and also for adjusting the trim position of the outboard drive. Both of these movements occur about a generally horizontally extending tilt axis. In many of the previously proposed systems of this type, the trim adjustment has been achieved by one or more hydraulic cylinders that are operative to engage the outboard drive for moving it through a plurality of trim adjusted positions from a normal trim condition to shallow water trim conditions. In addition, a tilt cylinder assembly is also interposed between the hull of the watercraft and the outboard drive for tilting the outboard drive up to its tilted up position. Such arrangements normally employ a single hydraulic control circuit and pump mechanism that supplies hydraulic fluid to the trim and tilt cylinders in a parallel flow arrangement. As a result, in order to tilt the outboard drive up to its tilted up position, it is necessary for the trim cylinders to be moved to their fully extended positions prior to the effective operation of the tilt cylinder. Such arrangements not only take longer to tilt the outboard drive up, but require readjustment of the trim position when the outboard drive is tilted back down to a running condition.

It is, therefore, a principal object of this invention to provide an improved tilt and trim unit for an outboard drive.

It is another object of this invention to provide an improved tilt and trim unit for an outboard drive wherein the outboard drive may be tilted up without altering the trim position set for the drive.

It is a further object of this invention to provide a tilt and trim arrangement for an outboard drive embodying separate tilt and trim cylinders and wherein the tilt cylinder may be employed to tilt up the motor without actuation of the trim cylinders.

SUMMARY OF THE INVENTION

This invention is adapted to be embodied in a tilt mechanism for a marine outboard drive comprising an outboard drive unit adapted to be supported for pivotal movement relative to an associated hull about a generally horizontally disposed axis from a normal running position to a tilted up out of the water position. A hydraulically operated trim cylinder assembly is operatively interposed between the hull and the outboard drive for pivoting the outboard drive relative to the hull between a normal running position and a plurality of trim adjusted positions. A hydraulically operated tilt cylinder assembly is also operatively interposed between the hull and the outboard drive for tilting the outboard drive from its normal running position or any of the trim adjusted positions to a tilted up position. Hydraulic control means control the operation of the trim cylinder assembly and the tilt cylinder assembly for controlling the position of the outboard drive unit relative to the hull.

In accordance with a first feature of the invention, the hydraulic control assembly includes means for pressurizing the tilt cylinder assembly independently of the trim cylinder assembly for tilting up the outboard drive without initial actuation of the trim cylinder assembly.

In accordance with another feature of the invention, the hydraulic circuit means includes means for effecting hydraulic actuation of the tilt cylinder assembly independently of operation of the trim cylinder assembly if the force resisting tilting up of the outboard drive is less than a predetermined value.

BRIEF DESCRIPTION OF THE DRAWINGS

FIG. 1 is a side elevational view of an outboard motor and associated watercraft having a tilt and trim unit constructed in accordance with the invention.

FIG. 2 is an enlarged side elevational view showing a tilt and trim arrangement.

DETAILED DESCRIPTION OF THE PREFERRED EMBODIMENT

Figure 3:
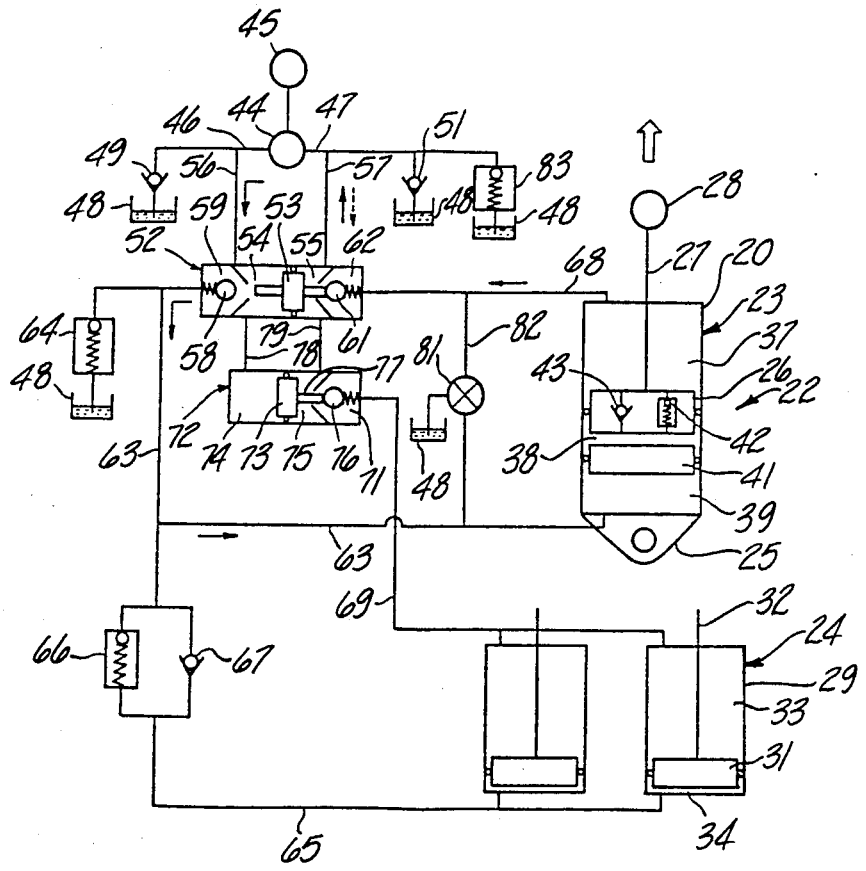
FIG. 3 is a partially schematic view showing the hydraulic system of the invention in the tilt up mode.

Referring first to FIG. 1, an outboard motor having a tilt and trim unit constructed in accordance with this invention is identified generally by the reference numeral 11. Although the invention is described in conjunction with an outboard motor, it can be equally as well practiced in connection with the outboard drive portion of an inboard-outboard arrangement. The application of the invention to such an outboard drive of an inboard-outboard unit is believed to be readily obvious to those skilled in the art.

The outboard motor 11 includes a power head 12 in which an internal combustion engine is positioned. The engine drives a drive shaft that is rotatably journaled in a drive shaft housing 13 and which terminates in a lower unit 14 in a known manner. The drive shaft drives a propulsion device carried by the lower unit 14, in this case a propeller 15, in a known manner.

The drive shaft housing 13 is supported for steering movement about a vertically extending axis by means of a swivel bracket 16. The swivel bracket 16 is, in turn, supported for pivotal movement about a horizontally extending axis by means of a pivot pin 17 and clamping bracket 18. As is well known, the clamping bracket 18 permits attachment of the motor 11 to a transom 19 of a watercraft 21 (shown in phantom). The construction of the clamping bracket 18, swivel bracket 16 and the steering and tilting construction of the motor 11 are not described in any more detail because this portion of the construction is conventional.

A hydraulic tilt and trim assembly, indicated generally by the reference numeral 22 and constructed and operated in accordance with the invention is interposed between the clamping bracket 18 and the swivel bracket 16 for controlling both the trim and tilt of the motor 11. The tilt and trim unit 22 comprises a single hydraulically operated tilt cylinder assembly 23 and a pair of hydraulically operated trim cylinder assemblies 24.

The tilt cylinder assembly 23 includes a main body 20 having a lug 25 formed at its lower end that provides a means for pivotal connection to the clamping bracket 18. The body 20 defines a cylinder bore in which a piston 26 is slidably supported. The piston 26 is connected to a piston rod 27 that has an eyelet 28 so as to provide a pivotal connection to the swivel bracket 16. Movement of the piston 26 within the cylinder causes the motor 12 to pivot about the pivot pin 17.

The trim cylinders 24 are each identical in construction and comprise a housing 29 in which a piston 31 is supported for reciprocation. Each piston 31 is affixed to a piston rod 32 that is adapted to engage the swivel bracket 16 or appropriate lugs formed upon it. The piston 31 of the trim cylinder assemblies 24 divides the housing 29 into an upper chamber 33 and a lower chamber 34. The cylinder 29 is affixed to the clamping bracket 18 so that reciprocation of the pistons 31 causes pivotal movement of the outboard motor 12 about the pivot pin 17.

The trim cylinder assemblies 24 are utilized to provide small adjustments in the trim angle of the motor 12 relative to the transom 19. The tilt assembly 23, on the other hand. is employed for providing larger degree pivotal movements of the motor 12 so that the motor 12 may be tilted up to bring the lower unit 14 and propeller 15 out of the body of water in which the motor is being operated, as shown in the phantom line view in FIG. 1.

The piston 26 of the tilt assembly 23 divides the cylinder into an upper chamber 37 and a lower chamber. The lower chamber itself is divided into an upper part 38 and a lower part 39 by means of a floating piston 41. The piston 41 is relatively freely floatable within the lower chamber and is operable, as will be apparent, so as to provide a further range of trim adjustment.

In addition to providing tilting action, the tilt cylinder assembly 23 provides hydraulic damping and reverse lock operation. For this purpose, a pair of passages are formed in the piston 26 for permitting flow between the upper chamber 37 and the upper portion 38 of the lower chamber. These passages are valved and include a pressure responsive absorber valve 42 of the check type that permits flow from the chamber 37 into the lower chamber upon portion 38 in response to a predetermined force tending to cause the motor 11 to tilt or pop up. The amount of the force necessary to open the valve 42 is set, as is well known, to the desired value. Return flow from the lower chamber portion 38 to the upper chamber 37 is permitted by means of a valve passage in which a return valve 43 is provided. The return valve 43 is adapted to open at a substantially lower pressure than the absorber valve 42, for example, the pressure generated by the weight of the outboard motor 11. In this way, the piston 26 may return to its normal trim condition when the force tending to pop the motor 11 up is removed, as will become apparent.

A hydraulic arrangement, shown schematically in FIGS. 3 through 8, is provided for operating the trim cylinders 24 so as to provide power up or power down trim adjustment and also so as to operate the tilt cylinder assembly 23 so as to provide power up or power down tilting operation. In addition, and as has been noted, the floating piston 41 may be adjusted by this hydraulic system so as to provide a further range of trim adjustment.

The hydraulic system includes a reversible, positive displacement pump, indicated schematically at 44, which is, in turn, driven by a reversible electric motor 45. The pump 44 is provided with a pair of inlet lines 46 and 47 that extend from a sump 48 and in which respective non-return check valves 49, 51 are provided.

A shuttle valve assembly, indicated generally by the reference numeral 52, is provided downstream of the pump 44 and includes a shuttle piston 53 that divides the interior of the shuttle valve into first and second chambers 54 and 55. Pressurized fluid may be delivered from the pump 44 to the chamber 54 through a pressure line 56 or returned by this same line. In a like manner, the chamber 55 communicates with the opposite side of the pump 44 through a conduit 57.

A check valve 58 is provided in the chamber 54 and controls flow into a still further chamber 59. In a similar manner, a check valve 61 controls the flow from the chamber 55 into a further chamber 62. The shuttle valve 53 has outwardly extending pin projections that are adapted to engage the balls of the check valves 58 or 61 so as to open these check valves, as will become apparent.

The chamber 59 communicates with a tilt up passage 63 in which a tilt up relief valve 64 is positioned. The tilt up relief valve 64 is adapted to open at a substantially higher pressure than the check valve 58. Passage 63 extends into the chamber 39 beneath the lowermost position of the floating piston 41.

A trim up pressure line 65 branches off of the tilt up pressure line 63. Communication between the lines 63 and 65 is controlled by means of a pressure responsive trim up valve 66 which permits flow from the line 63 to the line 65 when a greater than a predetermined pressure exists. In addition, the line 65 may communicate back with the line 63 through a pressure responsive check valve 67 that is positioned in parallel with the trim up valve 66. The passage 65 extends to the chambers 34 of the trim cylinders 24 on the underside of the trim pistons 31. Therefore, pressurization of the line 65 by opening of the trim control valve 66 will cause the pistons 31 to move outwardly and cause a trim up adjustment of the motor 11. It should be noted that the trim adjustment valve 66 is adapted to open at a lower pressure than the tilt up relief valve 64. The pressure required to open the trim valve 66 is, however, higher than the pressure required to open the check valve 58 of the shuttle valve assembly 52.

A tilt down pressure line 68 extends from the shuttle valve chamber 62 to the chamber 37 on the upper side of the piston 26 of the tilt cylinder 23.

A trim down line 69 extends from the chambers 33 of the trim pistons 24 to a chamber 71 of a second shuttle valve assembly 72. The shuttle valve assembly 72 includes a shuttle piston 73 that divides a chamber into first and second portions 74 and 75. A pressure responsive check valve 76 communicates the chamber 75 with the chamber 71. The pressure responsive check valve 76 is adapted to be engaged by a rod 77 carried by the shuttle piston 73 for opening the valve 76 under conditions to be described. The chamber 74 of the shuttle valve 72 communicates with the chamber 54 of the shuttle valve 52 through a conduit 78. The chamber 75 of the shuttle valve 72 communicates with the chamber 55 of the shuttle valve 52 through a conduit 79.

To permit manual tilting of the motor 11, a manually operated valve 81 is positioned in a conduit 82 that extends between the conduits 63 and 68 and which also controls communication with the sump 48.

OPERATION

FIG. 3 shows the condition of the mechanism during the tilt up mode. Assuming that the motor 11 is at a normal running position, is not driving the boat 21 at a high speed, and that the manual valve 81 is closed, if the operator desires to tilt the motor 11 up, through a suitable control, he operates the motor 45 so as to drive the pump 44 in a direction wherein the line 56 is pressurized and the line 57 acts as a return line. When the line 56 is pressurized, the pressure in the chamber 54 will exceed the pressure in the chamber 55 and the shuttle piston 53 of the shuttle valve assembly 52 will be forced to the right from its previous neutral position. When the shuttle piston 53 is shifted to the right, its projection will unseat the ball check valve 61 and open communication between the shuttle valve chambers 55 and 62.

Pressurization of the chamber 54 causes the ball check valve 58 to open. As has been previously noted, the check valve 58 opens at a substantially lesser pressure than the relief valve 64 and trim adjusting valve 66. Therefore, the line 63 will be pressurized so that pressure will be generated in the chamber 39 below the floating piston 41 so as to urge the piston 41 upwardly against the piston 26.

When the line 63 is pressurized and there is no substantial downward force on the outboard motor 11, as occurs when it is being driven at high speed, the force exerted on the piston rods 32 of the trim adjusting cylinders 24 will not be sufficient to cause pressure in the line 65 to rise sufficiently so as to open the trim adjusting valve 66. Therefore, there will be no communication between the lines 63 and 65 and the trim adjusting cylinders 24 will not be pressurized.

Fluid may be expelled from the chamber 37 on the upper side of the piston 26 so as to permit the outboard motor 11 to be tilted up. This fluid is driven through the line 68 into the shuttle valve chamber 62. Since the check valve 61 is held open, this fluid may pass through into the chamber 55 and be returned to the line 57, which now acts as a return line.

Pressurization of the chamber 54 of the shuttle valve 52 causes this pressure to be transmitted through the line 78 to the chamber 74 of the shuttle valve 72. This causes the piston 73 to be shifted to the right so that is projection 77 will unseat the ball check valve 76 and permit communication between the chambers 71 and 75. This will vent the chambers 33 of the trim pistons 24 to the return line, however, there will be no movement of the trim pistons 31 since their chambers 34 are not pressurized.

Figure 4:
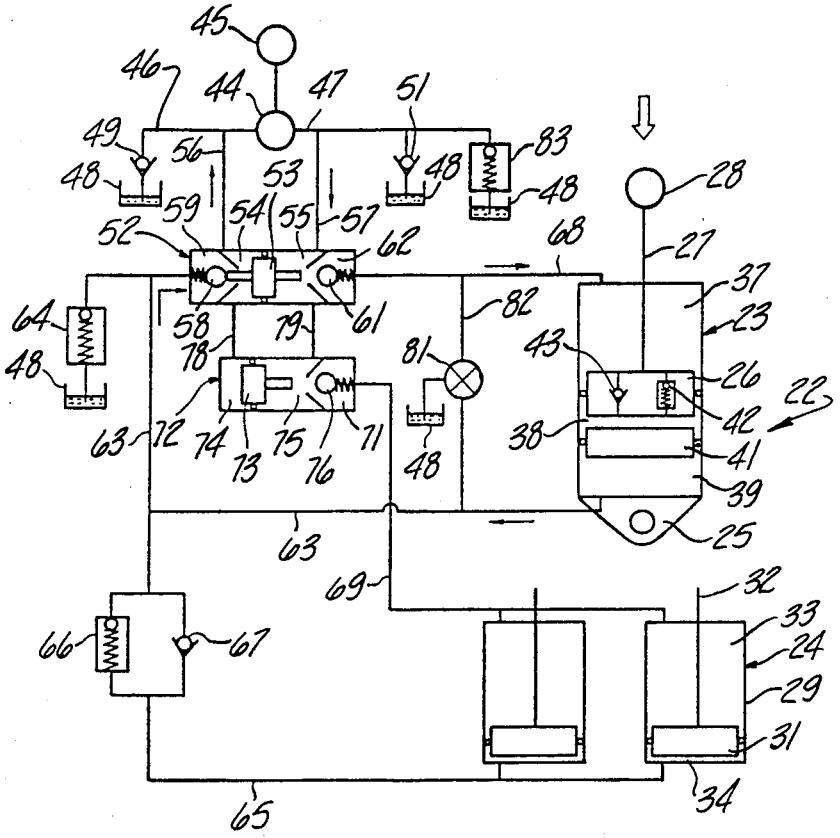
FIG. 4 is a schematic view, in part similar to FIG. 3, showing the tilt down mode.

The tilt down operation will now be described by reference to FIG. 4. Assuming that the motor 11 is in a tilted up condition, the piston 26 and floating piston 41 will be at the upper end of the cylinder 23. If the operator determines to tilt the motor down, the electric motor 45 is energized so as to drive the pump 44 in a direction to pressurize the line 57 and cause the line 56 to function as a pump return line.

When the line 57 is pressurized, the pressure in the chamber 55 of the shuttle valve assembly 52 will shift the shuttle piston 53 to the left to unseat the ball check valve 58. The pressure in the chamber 55 is sufficient to unseat the check valve 61 so as to communicate the chambers 55 and 62 with each other. Therefore, the line 68 will be pressurized and pressure will be exerted in the chamber 37 above the piston 26. The piston 26 and, accordingly, the floating piston 41 will be forced downwardly and the motor 11 will tilt down.

During downward movement of the pistons 26 and 41, fluid is expelled through the line 63. The return fluid enters the shuttle valve chamber 59 and passes through the opened valve 58 into the chamber 54 to the pump return line 56.

When the piston 26 and floating piston 41 bottom, the pressure in the line 47 will rise abruptly. If the pump 44 is still operated at this time, a tilt down relief valve 83 will then open so as to relieve the excessive pressures to the sump 48.

When the motor 11 is being tilted down, the pressurization of the shuttle valve chamber 52 will cause pressure to be generated in the line 79 so as to urge the piston 73 of the second shuttle valve 72 to the left. The pressure in the chamber 75 of this shuttle valve will be sufficient to unseat the check valve 76 and cause pressurization of the line 69 so as to urge the trim pistons 31 to their fully downward or retracted positions so that their piston rods 32 will not interfere with tilting down of the outboard motor 11.

When the desired position is reached, the operator again stops the motor 45 and the outboard motor 11 will be retained in the desired position by the lockage of hydraulic fluid in respective tilt and trim cylinder chambers.

Figure 5:
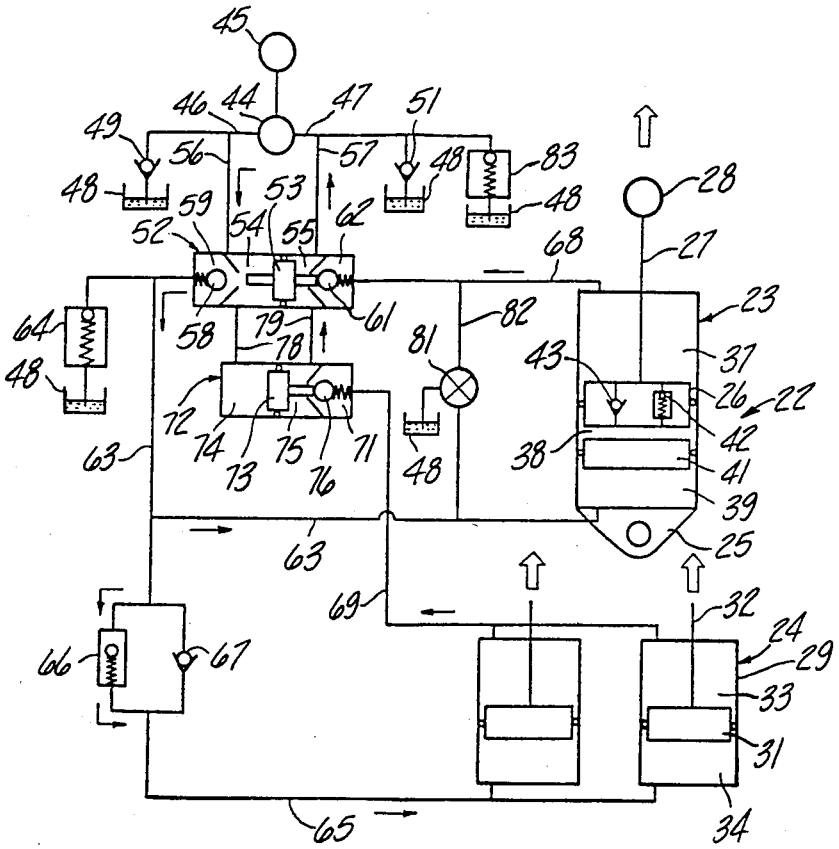
FIG. 5 is a schematic view, in part similar to FIGS. 3 and 4, showing the trim up mode.

It should be noted from the aforenoted description that tilting up and tilting down of the outboard motor 11 may be accomplished without necessitating movement of the motor 11 through the trim adjusting position at a low speed as afforded by the trim pistons 24 which have a substantially larger diameter, and hence, move more slowly than the pistons 26 and 41 of the trim cylinder 23. Thus, the motor may be tilted up or tilted down rapidly. However, if it is desired to achieve a trim up adjustment, this can be done when operating the boat 21 at a high speed in a forward direction. This condition is shown in FIG. 5.

When the boat is being operated at a high speed or with a high driving thrust in a forward direction and the operator desires to make a trim up adjustment, the motor 45 is again energized so as to drive the pump 44 in a direction so as to pressurize the line 56 and cause the line 57 to act as a return line. The shuttle piston 53 of the shuttle valve assembly 52 is then forced to the right to unseat the ball check valve 61 and open communication between the shuttle valve chambers 55 and 62. Pressurization of the chamber 54 causes the check valve 58 to open and pressurize the line 63.

When the line 63 is pressurized, the pressure will be exerted in the chamber 39 of the tilt cylinder assembly 23. However, due to the small size of the piston 26 and floating piston 41, there will not be sufficient force in the tilt cylinder assembly 23 to cause the motor 11 to tilt up under the high forward driving thrust. This will cause a larger pressure to be generated in the line 63 and the trim adjusting valve 66 will open causing the line 65 to be pressurized. Hence, there will be pressure exerted in the chambers 34 on the larger pistons 31 so as to cause the motor 11 to be trimmed up.

When the trim pistons 31 move upwardly, fluid will be displaced from their chambers 33 through the line 69. Since the shuttle valve chamber 54 of the shuttle valve 52 has been pressurized, the chamber 74 of the second shuttle valve 72 will be pressurized through the line 78. Hence, the shuttle piston projection 77 will unseat the check valve 76 and return fluid may flow from the line 69 to the shuttle valve chamber 55 for return through the return line 57. At the same time, fluid will be returned from the chamber 37 of the tilt cylinder 23 since the floating piston 41 and piston 26 will move upwardly along with the pistons 31. When the desired trim position is reached, the motor 45 is stopped and the device will be locked in position.

Figure 6:
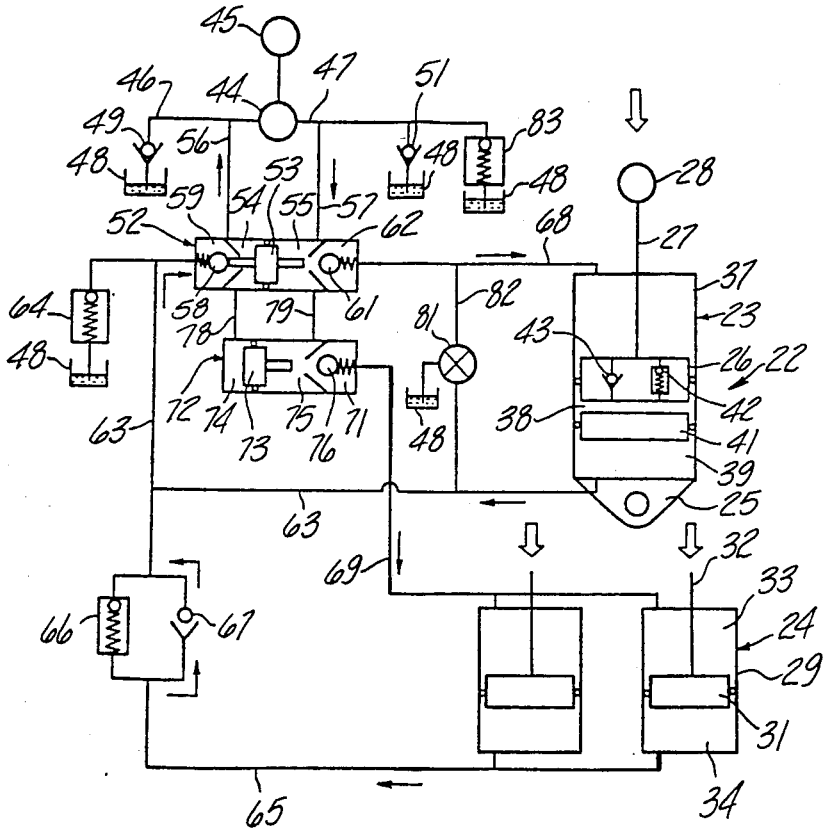
FIG. 6 is a schematic view, in part similar to FIGS. 3, 4 and 5, showing the trim down mode.

If it is desired to cause a trim down adjustment from a shallow water trim condition, the motor 45 is operated so as to drive the pump 44 in a direction to pressurize the line 57 and cause the line 56 to act as a return line (FIG. 6). This can be accomplished at any running speed.

When the line 57 is pressurized, the shuttle piston 53 of the first shuttle valve 52 will be urged to the left to unseat the check valve 58 and cause the line 63 to act as a return line. At the same time, pressurization of the shuttle chamber 55 will cause sufficient pressure to be exerted so as to unseat the check valve 61 and pressurize the line 68. Thus, pressure is exerted in the chamber 37 of the trim cylinder 23 above the piston 26. At the same time, the pressurization of the shuttle chamber 55 will cause pressure to be transmitted through the line 79 to the chamber 75 of the shuttle valve 72. The shuttle piston 73 will then be driven to the left. However, the pressure in the chamber 75 is sufficient to overcome the action of the ball check valve 76 and the line 69 going to the trim cylinder chambers 33 will also be pressurized. The cylinders 23 and 24 will then be retracted.

Return fluid flows from the tilt cylinder chamber 39 through the line 63 which, as has been noted, now acts as a return line. At the same time, pressure may be relieved from the trim cylinder chambers 34 through the line 65 past the check valve 67 which now opens under this condition so as to permit return flow. Once the desired trim down condition is reached, the motor 45 is again stopped and the device will be held in position.

Figure 7:
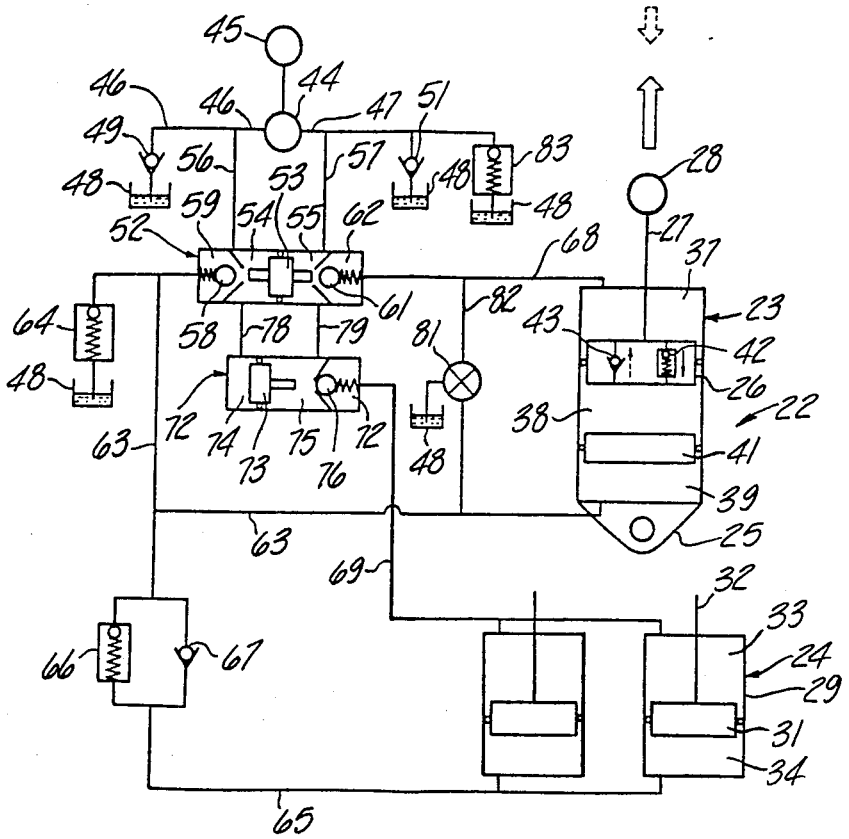
FIG. 7 is a schematic view, in part similar to FIGS. 3 through 6, showing popping up of the drive from a trim adjusted position.

As has been previously noted, the construction of the tilt cylinder 23 is such that it will absorb reverse thrust and also will permit the motor 11 to pop up under conditions when an obstacle is struck underwater. When the floating piston 41 is in a trimmed up condition as shown in FIG. 7 and the motor is operated in reverse, the piston 26 will tend to be drawn upwardly in the cylinder 23. However, the pressure responsive absorber valve 42 will be held closed under normal reverse running conditions and the motor 11 will not be permitted to pop up.

If an underwater obstacle is struck, however, sufficient force can be exerted as to cause the absorber valve 42 to open and permit the motor to pop up. This is shown by the solid line arrow in FIG. 7. Once the underwater obstacle is cleared, the weight of the motor acting on the piston 26 will be sufficient so as to cause the return valve 43 to open and permit the piston 26 to move downwardly until it again contacts the floating piston 41 and will then be held in the trimmed up condition.

Figure 8:
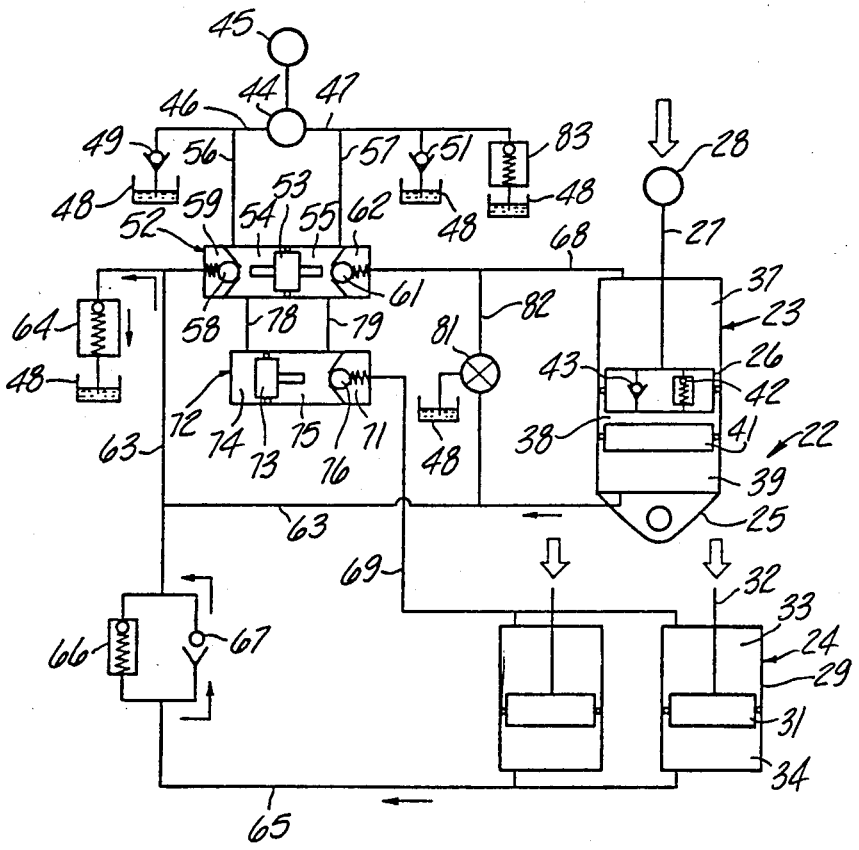
FIG. 8 is a schematic view, in part similar to FIGS. 3 through 7, showing shock absorption of the drive under reverse operation.

The described construction is also effective to provide some damping when the outboard motor 11 is in a shallow water position, the boat 21 is being driven rearwardly and an underwater obstacle is struck by the lower unit 14. Under these conditions, as shown in FIG. 8, a force will be applied downwardly on the motor 11 which tends to drive both the piston rod 27 of the tilt cylinder assembly 23 downwardly and the piston rods 32 of the trim cylinder assemblies 24 which also causes them to be driven downwardly.

The pressurization of the chambers 39 and 34 of the respective tilt and trim cylinder assemblies 23, 24 will pressurize the line3 63 and 65. If sufficient pressure is generated so as to overcome the pressure of the spring of the relief valve 64, the motor 11 will be permitted to recede with fluid being driven back to the reservoir 48 from the opening of the relief valve 64. Hence, some damping under shallow water reverse operation will also be provided by this mechanism.

It should be readily apparent from the foregoing description that an extremely simple, yet high effective, arrangement is provided that permits shallow water trim adjustment while at the same time permits rapid tilt up of the motor necessitating the trim mechanism to first go through its full range of trim adjustment. Although an embodiment of the invention has been illustrated and described, various changes and modifications may be made without departing from the spirit and scope of the invention, as defined by the appended claims.

I claim:

1. A tilt mechanism for a marine outboard drive comprising an outboard drive unit adapted to be supported for pivotal movement relative to an associated hull about a generally horizontally disposed axis from a normal running position to a tilted up out of the water position, a hydraulically operated trim cylinder assembly operatively interposed between the hull and the outboard drive for pivoting the outboard drive relative to the hull between a normal running position and a plurality of trim positions, a hydraulically operated tilt cylinder assembly operatively interposed between the hull and the outboard drive for tilting the outboard drive from a normal running position or any of said trim adjusted positions to a tilted up position, and hydraulic control means for controlling the operation of said trim cylinder assembly and said tilt cylinder assembly for controlling the position of the outboard drive unit relative to the hull, the improvement comprising said hydraulic control means including means for pressurizing said tilt cylinder assembly independently of said trim cylinder assembly for tilting up of said outboard drive without initial actuation of said trim cylinder assembly in response to the sensing of a pressurizing force in said control means less than the amount of pressurizing force required to effect trimming up of said outboard drive unit by said trim cylinder assembly.

2. A tilt mechanism as set forth in claim 1 wherein the trim cylinder assembly is operatively engaged with the outboard drive for trim adjustment of the outboard drive, the tilt cylinder assembly being pivotally connected at one end thereof to the outboard drive and at the other end thereof to the hull assembly.

3. A tilt mechanism as set forth in claim 2 wherein the hydraulic control provides parallel flow paths to the trim cylinder assembly and the tilt cylinder assembly.

4. A tilt mechanism as set forth in claim 3 wherein the means for sensing the force required to effect trimming up includes pressure responsive valve means interposed between the source of fluid pressure and the trim cylinder assembly for precluding pressurization of the trim cylinder assembly unless the pressure on the pressure responsive valve means exceeds a predetermined pressure.

5. A tilt mechanism as set forth in claim 4 wherein the predetermined pressure comprises a pressure necessary to overcome the force tending to resist trim adjustment of the outboard drive when a substantial driving thrust is being exerted thereby.

6. A tilt mechanism for a marine outboard drive comprising an outboard drive unit adapted to be supported for pivotal movement relative to an associated hull about a generally horizontally disposed axis from a normal running position to a tilted up out of the water position, a hydraulically operated trim cylinder assembly operatively interposed between the hull and the outboard drive for pivoting the outboard drive relative to the hull between a normal running position and a plurality of trim positions, a hydraulically operated tilt cylinder assembly operatively interposed between the hull and the outboard drive for tilting the outboard drive from a normal running position or any of said trim adjusted positions to a tilted up position, and hydraulic control means for controlling the operation of said trim cylinder assembly and said tilt cylinder assembly for controlling the position of the outboard drive unit relative to the hull, the improvement comprising said hydraulic control assembly including pressure responsive means effective for hydraulic actuation of said tilt cylinder assembly independent of operation of said trim cylinder assembly if the force resisting tilting up of said outboard drive is less than a predetermined value.

7. A tilt mechanism as set forth in claim 6 wherein the hydraulic control provides parallel flow paths to the trim cylinder assembly and the tilt cylinder assembly.

8. A tilt mechanism as set forth in claim 7 wherein the fluid pressure responsive means comprises pressure responsive valve means interposed between the source of fluid pressure and the trim cylinder assembly for precluding pressurization of the trim cylinder assembly unless the pressure on the pressure responsive valve means exceeds a predetermined pressure.

9. A tilt mechanism as set forth in claim 8 wherein the trim cylinder assembly has a substantially greater effective area than the tilt cylinder assembly.

* * * * *